US011918164B1

(12) United States Patent
Ross et al.

(10) Patent No.: US 11,918,164 B1
(45) Date of Patent: Mar. 5, 2024

(54) DISHWASHER APPLIANCE AND METHOD OF OPERATING A PUMP BASED ON SUMP WATER

(71) Applicant: Haier US Appliance Solutions, Inc., Wilmington, DE (US)

(72) Inventors: Christopher Brandon Ross, Louisville, KY (US); Kyle Edward Durham, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/953,616

(22) Filed: Sep. 27, 2022

(51) Int. Cl.
*A47L 15/42* (2006.01)
*A47L 15/46* (2006.01)

(52) U.S. Cl.
CPC ..... *A47L 15/4221* (2013.01); *A47L 15/4225* (2013.01); *A47L 15/4244* (2013.01); *A47L 15/46* (2013.01); *A47L 2401/09* (2013.01); *A47L 2401/14* (2013.01); *A47L 2501/05* (2013.01)

(58) Field of Classification Search
None
See application file for complete search history.

(56) References Cited

U.S. PATENT DOCUMENTS

| | | | |
|---|---|---|---|
| 3,924,652 | A | 12/1975 | Kah |
| 7,047,986 | B2 | 5/2006 | Ertle et al. |
| 8,834,648 | B2 | 9/2014 | Fountain |
| 8,858,729 | B2 | 10/2014 | Buddharaju et al. |
| 8,915,257 | B2 | 12/2014 | Büsing et al. |
| 8,978,674 | B2 | 3/2015 | Büsing et al. |
| 9,027,578 | B2 | 5/2015 | Boyer et al. |
| 9,649,006 | B2 | 5/2017 | Dries |
| 9,763,552 | B2 | 9/2017 | Chapman et al. |
| 9,795,271 | B2 | 10/2017 | Durham et al. |
| 9,797,191 | B2 | 10/2017 | Huang |
| 10,010,235 | B2 | 7/2018 | Gephart et al. |
| 10,791,905 | B2 | 10/2020 | Dries et al. |
| 2010/0121497 | A1 | 5/2010 | Heisele et al. |
| 2012/0291822 | A1 | 11/2012 | Tuller et al. |
| 2013/0008477 | A1 | 1/2013 | Forst et al. |
| 2015/0230687 | A1 | 8/2015 | Dries et al. |
| 2016/0367106 | A1 | 12/2016 | Thiyagarajan et al. |
| 2019/0179350 | A1 | 6/2019 | Durham |
| 2021/0259510 | A1 | 8/2021 | Durham |

FOREIGN PATENT DOCUMENTS

| | | | |
|---|---|---|---|
| CN | 112941808 | A | 6/2021 |

*Primary Examiner* — Levon J Shahinian
(74) *Attorney, Agent, or Firm* — Dority & Manning, P.A.

(57) ABSTRACT

A method of determining a position of a diverter of a fluid circulation system in a dishwasher appliance includes determining a total amount of water supplied to the dishwasher appliance; activating a pump at a predetermined speed in response to determining the total amount of water supplied to the dishwasher appliance, the predetermined speed being based on the determined total amount of water; measuring a fluid pressure of an amount of sump water provided within a sump of the dishwasher appliance after activating the pump at the predetermined speed, the amount of sump water being at least part of the total amount of water; and determining a position of the diverter in response to measuring the fluid pressure of the amount of sump water, the position of the diverter being dependent on the measured fluid pressure.

9 Claims, 8 Drawing Sheets

DISHWASHER APPLIANCE AND METHOD OF OPERATING A PUMP BASED ON SUMP WATER

FIELD OF THE INVENTION

The subject matter of the present disclosure relates generally to dishwasher appliances, and more particularly to fluid circulation systems within dishwasher appliances and related methods.

BACKGROUND OF THE INVENTION

Dishwasher appliances generally include a tub that defines a wash compartment. Rack assemblies can be mounted within the wash chamber of the tub for receipt of articles for washing. Spray assemblies within the wash chamber can apply or direct wash fluid towards articles disposed within the rack assemblies in order to clean such articles. Multiple spray assemblies can be provided including, e.g., a lower spray arm assembly mounted to the tub at a bottom of the wash chamber, a mid-level spray arm assembly mounted to one of the rack assemblies, or an upper spray assembly mounted to the tub at a top of the wash chamber.

Dishwasher appliances further typically include a fluid circulation system which is in fluid communication with the spray assemblies for circulating fluid to the spray assemblies. The fluid circulation system may be selectively operable in one of two or more various modes based at least in part on a position of a diverter. Some dishwasher appliances utilize a detection of water pressure within a sump to determine the position of the diverter and thereby determine which operating mode, e.g., upper rack mode lower rack mode, or dual rack mode, is active.

However, such position sensors are susceptible to misreadings, inaccurate determinations, and the like. For instance, accurate measurements of water pressure within the sump depends on a specific amount of water while operating the pump at a specific speed to determine a position of the diverter. Pumping a low amount of water at a high speed can give false readings on the position of the diverter, as one example.

Accordingly, improved methods of operating a dishwasher appliance or determining a position of a diverter in a dishwashing appliance are desired. In particular, methods that guarantee accurate pressure readings would be advantageous.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of determining a position of a diverter of a fluid circulation system in a dishwasher appliance is provided. The method may include determining a total amount of water supplied to the dishwasher appliance; activating a pump at a predetermined speed in response to determining the total amount of water supplied to the dishwasher appliance, the predetermined speed being based on the determined total amount of water; measuring a fluid pressure of an amount of sump water provided within a sump of the dishwasher appliance after activating the pump at the predetermined speed, the amount of sump water being at least part of the total amount of water; and determining a position of the diverter in response to measuring the fluid pressure of the amount of sump water, the position of the diverter being dependent on the measured fluid pressure.

In another exemplary aspect of the present disclosure, a dishwasher appliance is provided. The dishwasher appliance may include a wash chamber selectively receiving articles for washing; a sump provided in fluid communication with the wash chamber via a fluid circulation system; a pump fluidly connected with the sump; a diverter provided in the fluid circulation system; and a controller operably connected with the pump, the controller configured to perform a locating operation. The locating operation may include determining a total amount of water supplied to the dishwasher appliance; activating the pump at a predetermined speed in response to determining the total amount of water supplied to the dishwasher appliance, the predetermined speed being based on the determined total amount of water; measuring a fluid pressure of an amount of sump water provided within the sump of the dishwasher appliance after activating the pump at the predetermined speed, the amount of sump water being at least part of the total amount of water; and determining a position of the diverter in response to measuring the fluid pressure of the amount of sump water, the position of the diverter being dependent on the measured fluid pressure.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
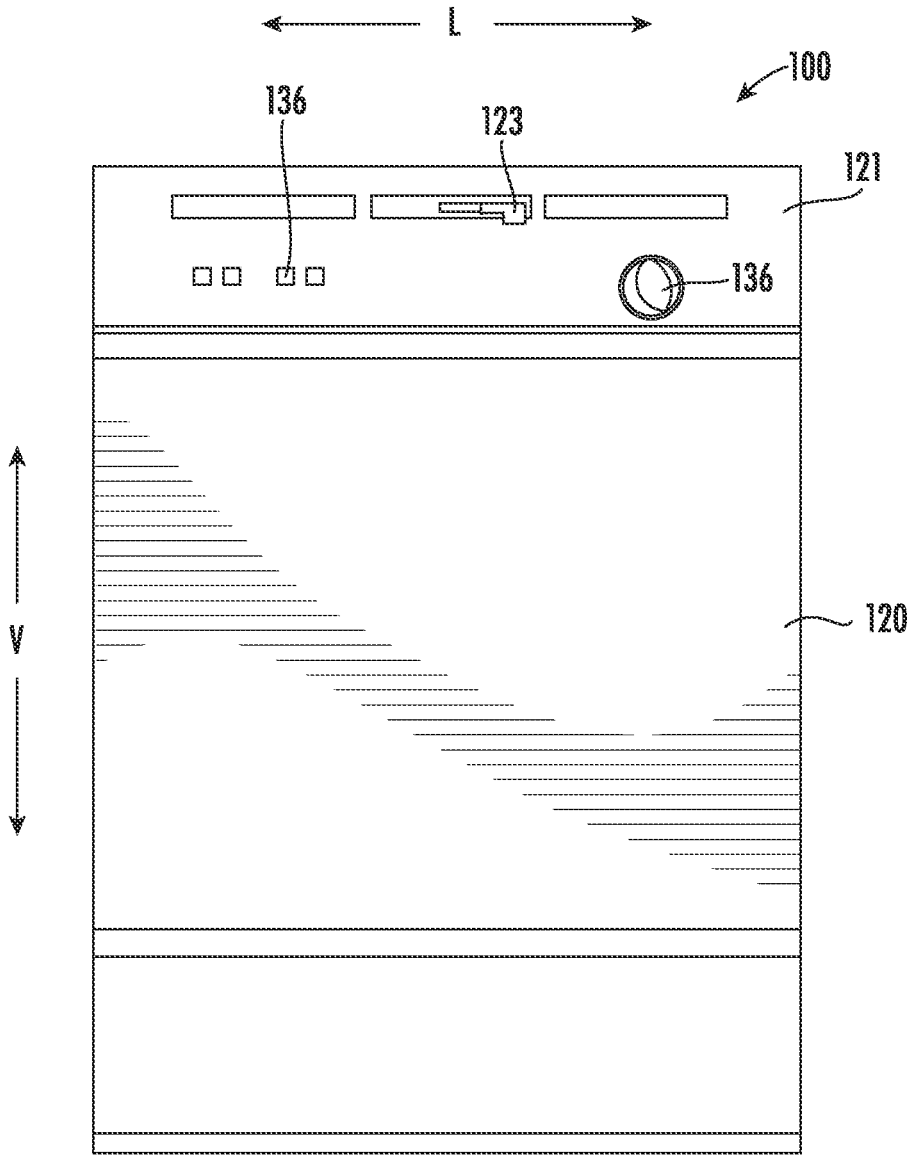
FIG. 1 provides a front view of a dishwasher appliance in accordance with one embodiment of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
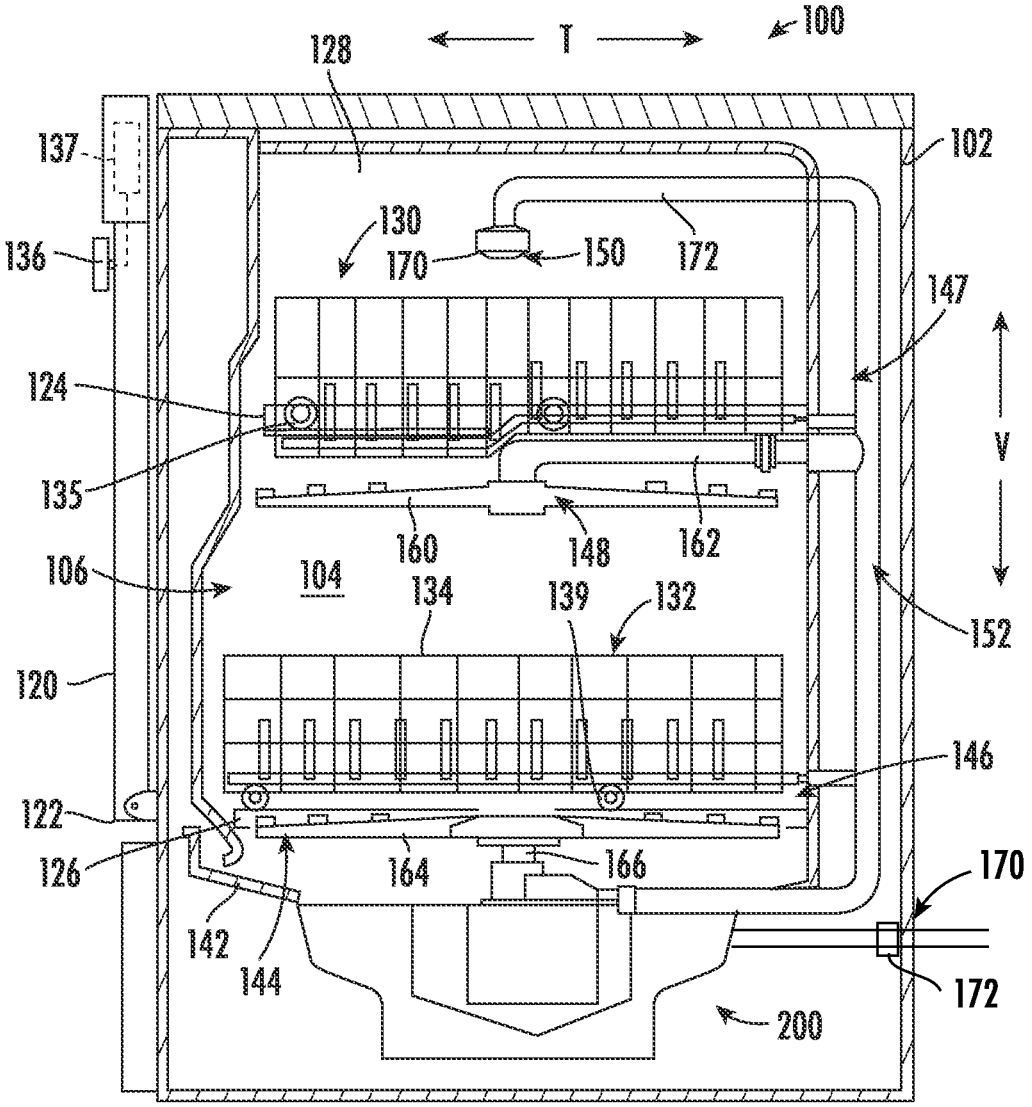
FIG. 2 provides a side, cross-sectional view of the dishwasher appliance of FIG. 1.

FIGS. 1 and 2 depict an exemplary domestic dishwasher appliance 100 that may be configured in accordance with aspects of the present disclosure. For the particular embodiment of FIGS. 1 and 2, the dishwasher appliance 100 includes a cabinet 102 having a tub 104 therein that defines a wash chamber 106. As shown, the dishwasher appliance 100 (such as the cabinet 102 thereof) defines a vertical direction V, a lateral direction L, and a transverse direction T, which are mutually orthogonal and define a coordinate system for the dishwasher appliance. The tub 104 includes a front opening (not shown) and a door 120 hinged at its bottom 122 for movement between a normally closed vertical position (shown in FIGS. 1 and 2), wherein the wash chamber 106 is sealed shut for washing operation, and a horizontal open position for loading and unloading of articles from the dishwasher. A latch 123 may be used to lock and unlock door 120 for access to chamber 106. Dishwasher appliance 100 may include a water inlet 170. Water inlet 170 may provide fluid communication between a sump 200 (described below) and a municipal water supply, for example. A flow meter 172 may be fluidly coupled at the water inlet 170 to selectively measure or otherwise determine an amount of water supplied to appliance 100. Flow meter 172 may be operably connected with a controller 137 (described below).

Upper and lower guide rails 124, 126 are mounted on tub side walls 128 and accommodate roller-equipped rack assemblies 130 and 132. Each of the rack assemblies 130, 132 is fabricated into lattice structures including a plurality of elongated members 134 (for clarity of illustration, not all elongated members making up assemblies 130 and 132 are shown in FIG. 2). Each rack 130, 132 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by rollers 135 and 139, for example, mounted onto racks 130 and 132, respectively. A silverware basket (not shown) may be removably attached to rack assembly 132 for placement of silverware, utensils, and the like, that are otherwise too small to be accommodated by the racks 130, 132.

The dishwasher appliance 100 further includes a lower spray-arm assembly 144 that is rotatably mounted within a lower region 146 of the wash chamber 106 and above a bottom wall 142 of the tub 104 so as to rotate in relatively close proximity to rack assembly 132. A mid-level spray-arm assembly 148 is located in an upper region 147 of the wash chamber 106 and may be located in close proximity to upper rack 130. Additionally, an upper spray assembly 150 may be located above the upper rack 130.

Each spray assembly 144, 148, 150 may include a spray arm or other sprayer and a conduit in fluid communication with the sprayer. For example, mid-level spray-arm assembly 148 may include a spray arm 160 and a conduit 162. Lower spray-arm assembly 144 may include a spray arm 164 and a conduit 166. Additionally or alternatively, upper spray assembly 150 may include a spray head 170 and a conduit 172 in fluid communication with the spray head 170. Each spray assembly 144, 148, 150 may include an arrangement of discharge ports or orifices for directing washing liquid received from a diverter 300 (described below) onto dishes or other articles located in rack assemblies 130 and 132. The arrangement of the discharge ports in spray-arm assemblies 144 and 148 provides a rotational force by virtue of washing fluid flowing through the discharge ports. The resultant rotation of the spray-arm assemblies 144 and 148 and the operation thereof using fluid from diverter 300 provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc.

The lower and mid-level spray-arm assemblies 144, 148 and the upper spray assembly 150 are part of a fluid circulation system 152 for circulating fluid in the dishwasher appliance 100. The fluid circulation system 152 may also include various components for receiving fluid from the wash chamber 106, filtering the fluid, and flowing the fluid to the various spray assemblies such as the lower and mid-level spray-arm assemblies 144, 148 and the upper spray assembly 150.

Each spray assembly 144, 148, 150 may receive an independent stream of fluid, may be stationary, or may be configured to rotate in one or both directions. For example, a single spray arm may have multiple sets of discharge ports, each set receiving wash fluid from a different fluid conduit, and each set being configured to spray in opposite directions and impart opposite rotational forces on the spray arm. In order to avoid stalling the rotation of such a spray arm, wash fluid is typically only supplied to one of the sets of discharge ports at a time.

The dishwasher appliance 100 is further equipped with a controller 137 to regulate operation of the dishwasher appliance 100. The controller may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher appliance 100. In the illustrated embodiment, the controller 137 is located within a control panel area 121 of door 120 as shown in FIGS. 1 and 2. In such an embodiment, input/output ("I/O") signals may be routed between the control system and various operational components of dishwasher 100 along wiring harnesses that may be routed through the bottom 122 of door 120. Typically, the controller 137 includes a user interface panel/controls 136 through which a user may select various operational features and modes and monitor progress of the dishwasher 100. In one embodiment, the user interface 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses. It should be noted that controllers 137 as disclosed herein are capable of and may be operable to perform any methods and associated method steps as disclosed herein.

It should be appreciated that the invention is not limited to any particular style, model, or configuration of dishwasher. The exemplary embodiment depicted in FIGS. 1 and 2 is for illustrative purposes only. For example, different locations may be provided for user interface 136, different configurations may be provided for racks 130, 132, different combinations of spray assemblies may be utilized, and other differences may be applied as well.

Figure 3:
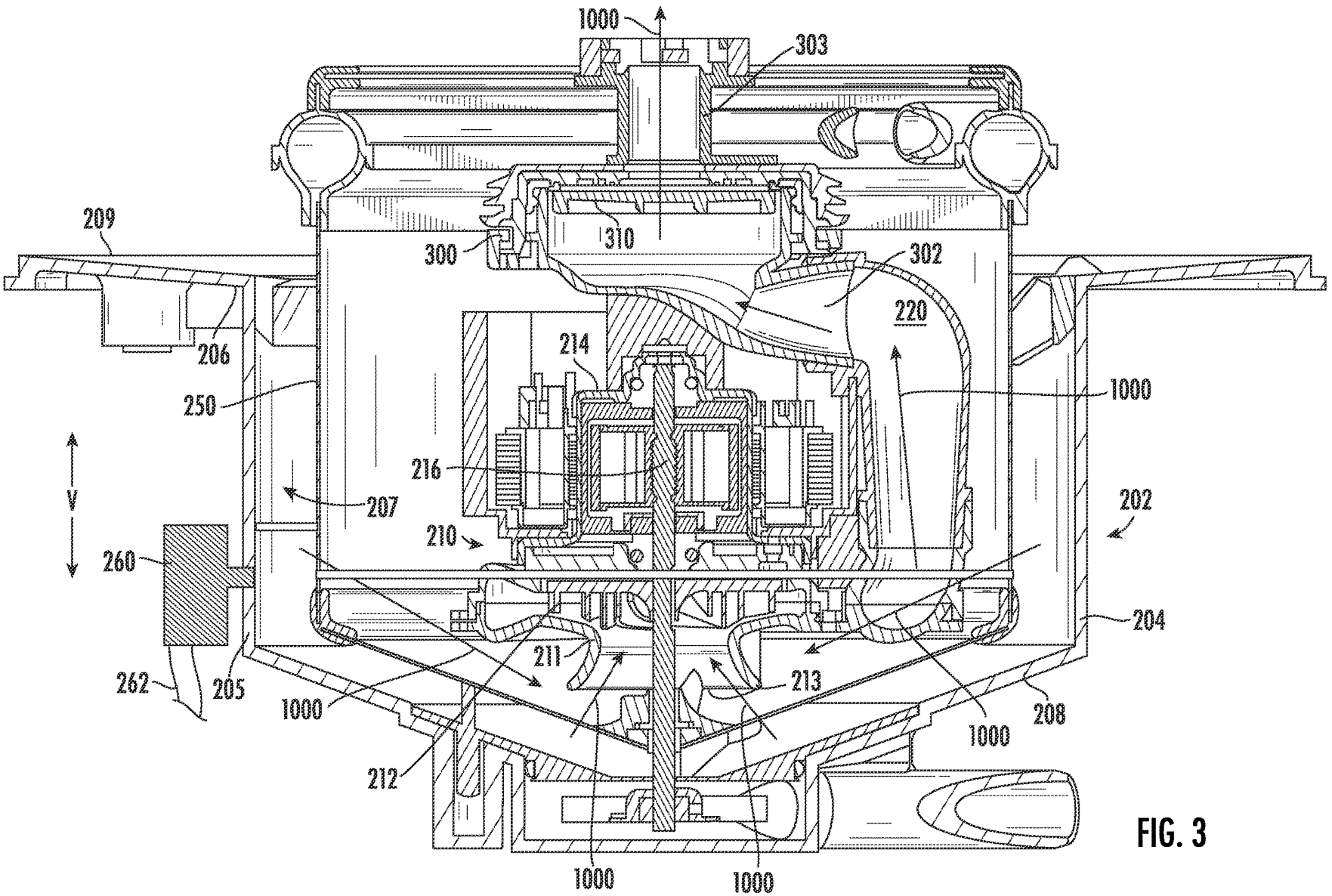
FIG. 3 provides a cross-sectional view of a fluid circulation system for a dishwasher appliance with a diverter in a first position in accordance with one embodiment of the present disclosure.

Referring now to FIG. 3, embodiments of portions of the fluid circulation system 152 of a dishwasher appliance 100 are illustrated. As shown, system 152 may include, for example, a sump 200 (shown in FIG. 2) for receiving fluid from the wash chamber 106. The sump 200 may be mounted to the bottom wall 142 and fluid may for example flow from the bottom wall 142 into the sump 200. Sump 200 may include and define, for example, a chamber 202 which receives the fluid from the wash chamber 106. As illustrated, sump 200 may include a sidewall 204 and a base wall 208 which define the chamber 202. For example, an inner surface 207 of the sidewall 204 may partially define the chamber 202. The sidewall 204 may extend from the base wall 208, such as generally along the vertical direction V. As mentioned above, "generally" in the context of an angle or direction means within ten degrees, e.g., generally along the vertical direction may include within ten degrees of vertical. In some embodiments, the sidewall 204 has a generally circular cross-sectional shape. Additionally or alternatively, the sidewall 204 may have a generally rectangular or other suitable polygonal cross-sectional shape, with multiple linear or curvilinear portions. Sidewall 204 may extend between a bottom end 205 (which may be connected to the base wall 208) and a top end 206 (which may be spaced from the base wall 208 along the vertical direction V).

Sump 200 may additionally include a skirt 209. The skirt 209 may extend from the sidewall 204, such as from the top end 206, away from the chamber 202 and away from a filter 250 disposed at least partially within the chamber 202 (as discussed herein). For example, the skirt 209 may extend generally perpendicularly to sidewall 204 or generally radially from the sidewall 204. As noted above, generally perpendicular is understood to include forming an angle within ten degrees of perpendicular, e.g., from eighty degrees to one hundred degrees, similarly, generally radial includes within ten degrees of radial. Fluid flowing into the chamber 202 may flow along skirt 209 until the skirt 209 reaches the sidewall 204, and the fluid may then flow into the chamber 202. Skirt 209 may, for example, be mounted to bottom wall 142.

System 152 may further include a pump 210 which provides pressurized fluid flow to a diverter 300 via a conduit 220. Pump 210 may include an impeller 212 which is disposed within the chamber 202. In some embodiments, the impeller 212 may be enclosed within a housing 211, and the housing 211 may include an intake 213 for drawing fluid into pump 210, e.g., to the impeller 212. Pump 210 may further include a motor 214 and a shaft 216 which connects the motor 214 and impeller 212. For example, the motor 214 may be disposed within the chamber 202 and may be hermetically sealed to prevent damage thereto from fluids within the chamber 202. Additionally or alternatively, the shaft 216 may extend through the base wall 208, and the motor 214 may be external to the chamber 202. Impeller 212 may spin within the chamber 202 when activated by the motor 214 to influence the flow of fluid within the chamber 202. Accordingly, fluid provided within sump 200 may be pumped via pump 210 to one or more of spray assemblies 144, 148, and 150 (e.g., in a direction as indicated by arrow 1000 in FIG. 3).

Dishwashing appliance 100 may include a pressure sensor, e.g., a pressure transducer 260, fluidly connected with sump 200 and configured to measure a pressure within the chamber 202 of the sump, e.g., corresponding to a fluid level within the sump 200. For example, more than one fluid level may, in some embodiments, be found within the chamber 200. In other embodiments, only one fluid level may be present in the chamber 202. The pressure sensor 260 may be configured to sense or measure a pressure corresponding to the first fluid level. For example, the pressure sensor may be positioned proximate the bottom end 205 of the sidewall 204 to measure a pressure generally corresponding to a height of the fluid between the bottom end 205 and the top end 206. One or more wires 262 may extend from the pressure sensor 260, e.g., to the controller 137. When the pressure sensor 260 is positioned outside of the sump 200 as shown, the wires 262 do not need to extend through a wall, e.g., one or both of the base wall 208 and sidewall 204, of the sump 200, thereby reducing possible leakage points by which fluid may escape from the sump 200.

Figure 4:
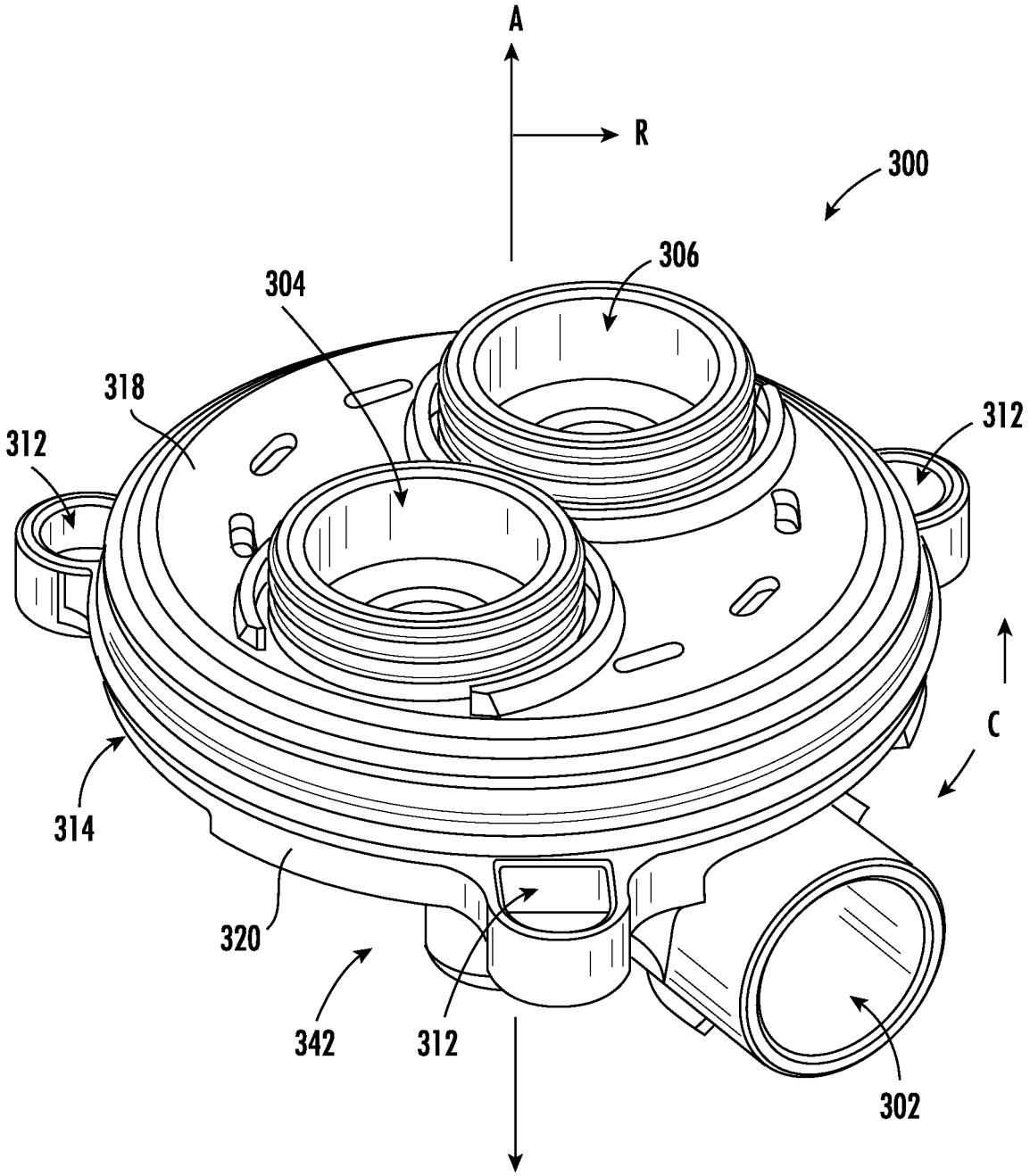
FIG. 4 is a perspective view of an exemplary embodiment of a passive diverter of the present invention.
Figure 5:
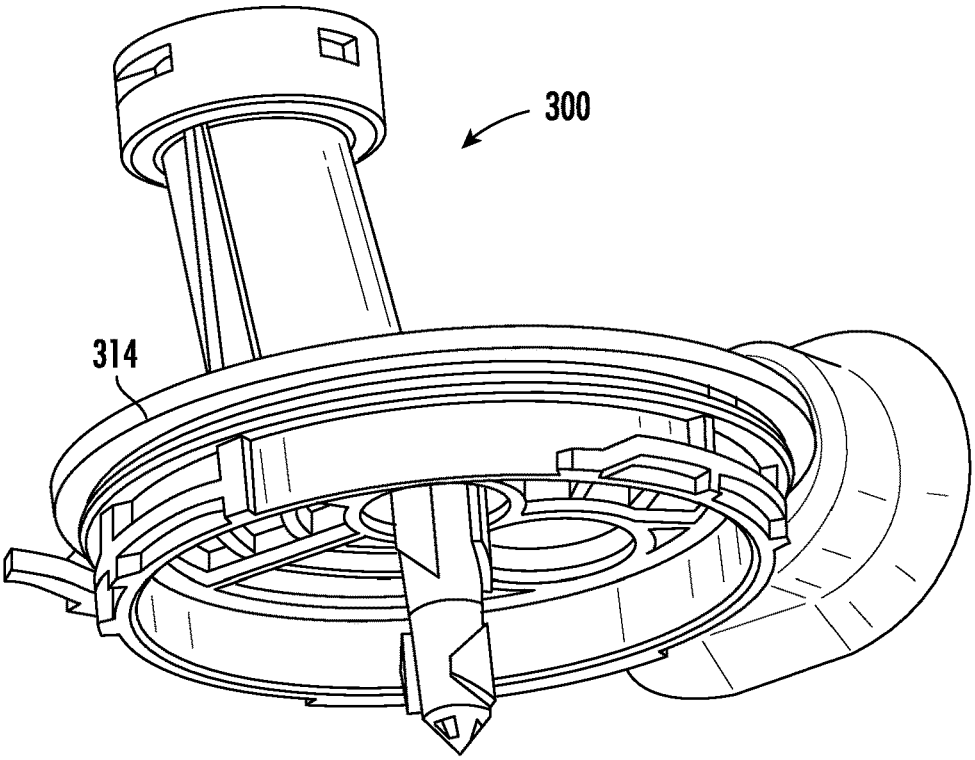
FIG. 5 is a perspective view of a diverter housing of the exemplary passive diverter of FIG. 4.

FIG. 4 provides a top perspective view of an exemplary embodiment of a diverter (e.g., passive diverter) 300 of the present disclosure. Passive diverter 300 defines an axial direction A, a radial direction R, and a circumferential direction C. Passive diverter 300 may include a fluid inlet 202 for receiving a flow of fluid from pump 210 that is to be supplied to spray assemblies 144, 148, or 150 as well as other fluid-using components during cleaning operations. As stated, pump 210 receives fluid from e.g., sump 200 and provides a fluid flow to diverter 300.

For this exemplary embodiment, diverter 300 includes a plurality of outlet ports (e.g., shown in FIG. 4) as first outlet port 304 and a second outlet port 306. It should be noted, however, that in other embodiments of the disclosure, three, four, or more than four outlet ports may be used with diverter 300 depending upon the number of switchable ports desired for selectively placing pump 210 in fluid communication with different fluid-using elements of appliance 100. Diverter 300 may include a valve 310 (see, e.g., FIG. 6), more fully described below, that can be selectively switched between ports 304 and 306 by using a hydraulic actuation mechanism.

By way of example, first outlet port 304 may be fluidly connected with upper spray assembly 150 and lower spray arm assembly 144 and second outlet port 306 may be fluidly connected with mid-level spray arm assembly 148. Other spray assemblies and connection configurations may be used as well. As such, the rotation of valve 310 in passive diverter 300 may be used to selectively place pump 210 in fluid communication with spray assemblies 144, 148, or 150 by way of outlet ports 304 and 306, as described in an exemplary embodiment below. Diverter 300 may also include multiple apertures 312 that allow for fastening diverter 300 to sump 200 of wash tub 104.

Passive diverter 300 may be constructed from or otherwise include a housing 314 that includes a first portion 318 and a second portion 320. An O-ring may provide a fluid seal therebetween. Housing 314 may define a chamber into which fluid flows through its fluid inlet 302. The chamber may also define a fluid outlet. In this manner, the chamber may provide fluid communication into the chamber through the fluid inlet 302 and out of the chamber through the fluid outlet to one or more of the outlet ports 304, 306. Additionally or alternatively, valve 310 may be at least partially positioned within the chamber. For instance, a disk 356 (described below) may be received within the chamber of housing 314. Accordingly, fluid introduced to the chamber (e.g., via fluid inlet 302) may fluidly interact with valve 310 before exiting the chamber (e.g., via one or more of outputs 304 and 306).

Figure 6:
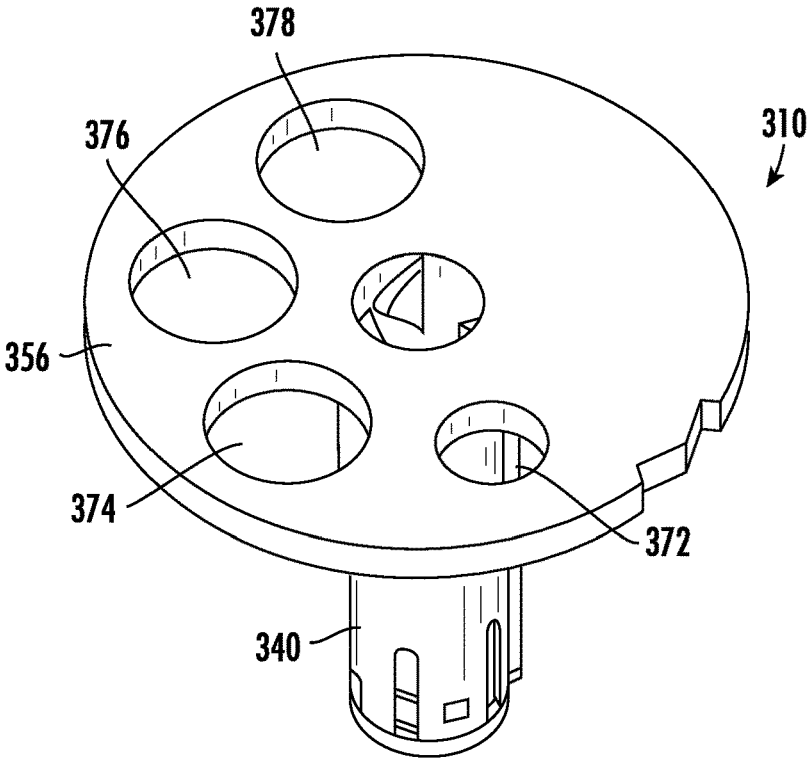
FIG. 6 is a perspective view of a valve of the exemplary passive diverter of FIG. 4.

Valve 310 may be positioned within the fluid outlet of the chamber and may be defined with respect to the axial direction A, the radial direction R, and the circumferential direction C (see, e.g., FIG. 6). More particularly, valve 310 may include a cylindrically-shaped shaft 340 that extends along the axial direction A and is received into a cylindrically-shaped well 342 formed by second portion 320 of housing 314. This cylindrically-shaped shaft 340 may be slidably received within well 342 of housing 314, such that valve 310 is rotatable about axis A-A relative to housing 314 and movable back and forth along axial direction A. Valve 310 may further include a disk 356 extending from a top end of shaft 340 about the radial direction R. Disk 356 may include a plurality of outlet holes or apertures defined therein (e.g., along the axial direction A) which will be described below. As valve 310 selectively rotates about the circumferential direction C, one or more of the apertures (372, 374, 376, 378) may be aligned with outlet ports 304, 306 (e.g., along the axial direction A).

Valve 310 may be movable along the axial direction A (or along axis A-A, which is parallel to the axial direction A) between a first position and a second position. Movement of valve 310 back and forth between the first position and the second position may be provided by two opposing forces: i) a flow of water passing through diverter 300 that is counteracted by ii) gravity. More particularly, when pump 210 is off, gravity may force valve 310 downward along axis A-A to the first position. Conversely, when there is a sufficient flow of fluid F through diverter 300, the momentum of fluid exiting the chamber through the fluid outlet of housing 314 will impact valve 310. As the fluid passes through apertures 372, 374, 376, 378 to exit diverter 300 through one (or more) of the outlet ports 304, 306, this momentum overcomes the force provided by gravity so as to shift valve 310 along axial direction A away from diverter bottom 320 towards diverter top 318 to the second position.

Figure 7:
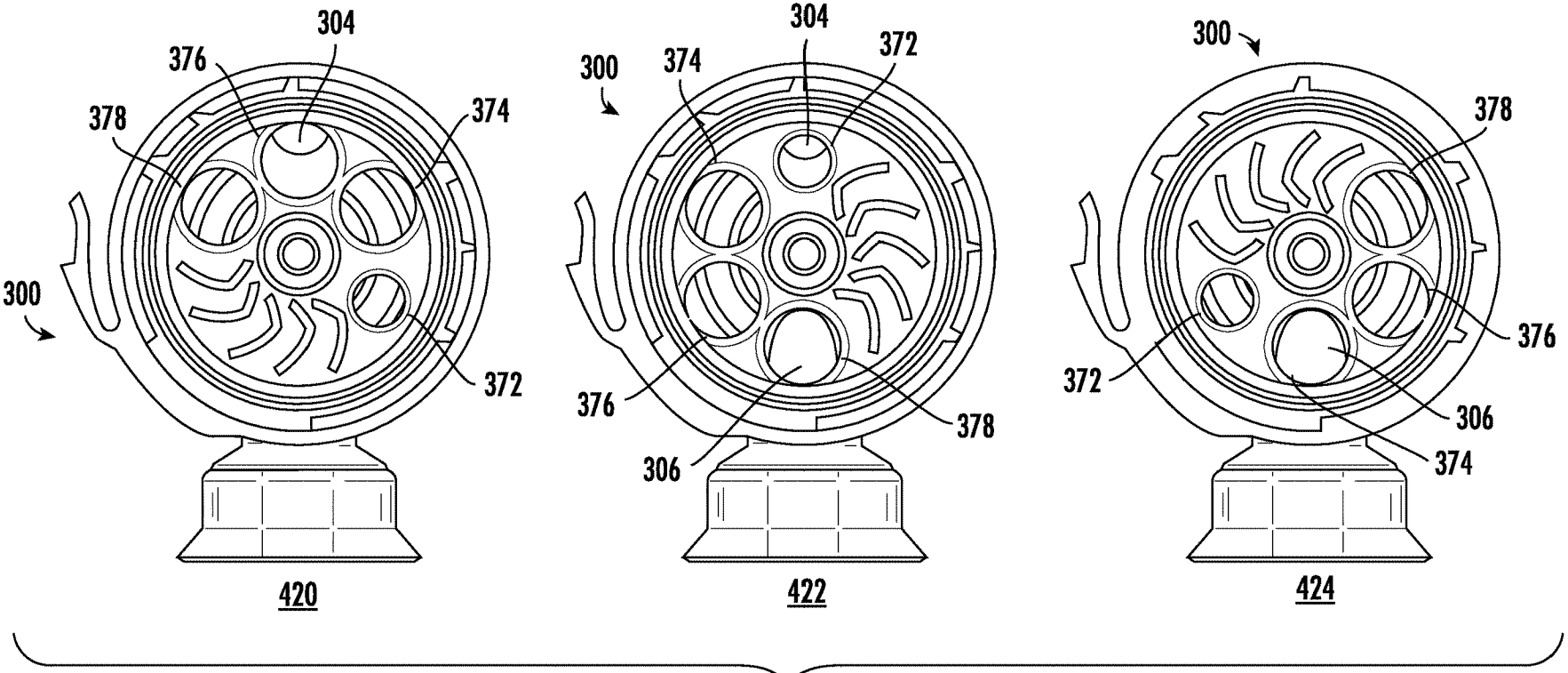
FIG. 7 is a schematic bottom view of a diverter valve inside the first portion of the housing of an exemplary diverter as the diverter valve is rotated between selected angular positions.

As noted above, disk 356 of valve 310 may include a plurality of apertures 372, 374, 376, 378 which may be selectively placed in fluid communication with one or more outlet ports 304, 306 to provide fluid flow to spray assemblies 144, 148, and 150. For example, as shown in the illustrated embodiment of FIGS. 6 and 7, disk 356 may include a first aperture 372, a second aperture 374, a third aperture 376, and a fourth aperture 378. Disk 356 may be rotated so as to place one or more of its apertures 372, 374, 376, 378 in fluid communication with one or more of outlet ports 304, 306. As shown in FIG. 4, fluid outlet ports 304, 306 are spaced apart circumferentially on first portion 318 of housing 314 (e.g., by 180 degrees). Apertures 372, 374, 376, 378 may be positioned along the circumferential direction C at 0, 60, 120, and 180 degrees, respectively.

Notably, this geometry of outlet ports 304, 306 and apertures 372, 374, 376, 378 provides three modes of operation wherein disk 356 is configured to rotate (e.g., in 120 degree increments). This rotation may be achieved by using three cams along with three upper and three lower guide elements configured to provide a set increment or amount (e.g., 120 degrees) of rotation about the axial direction. This operation is shown schematically in FIG. 7, which show disk 356 of valve 310 rotating (as viewed looking up on first portion 318) within first portion 318 of housing 314 in 120 degree increments. A first angular position 420 may correspond with a single-spray configuration. For instance, aperture 376 may be in fluid communication with outlet port 304 while apertures 372, 374 and 378 are blocked. In detail, in the first angular position, aperture 376 may be aligned with outlet port 304 along the axial direction A while each of apertures 372, 374, and 378 are circumferentially offset from each of outlet ports 304 and 306. Therefore, when valve 310 is rotated to place disk 356 in a first angular position 420, a flow of fluid from pump 210 is supplied one spray assembly (e.g., bottom spray assembly 144 or middle spray assembly 148.

Similarly, disk 356 may be rotated within housing 314 to a second angular position 422, which is 120 degrees from the first angular position 420. Second angular position 422 may correspond to a dual-spray configuration. In detail, aperture 372 may be in fluid communication with fluid outlet port 304 and aperture 378 may be in fluid communication with fluid outlet port 306, while apertures 374 and 376 are blocked. In the second angular position, aperture 372 may be aligned with outlet port 304 along the axial direction A and aperture 378 may be aligned with outlet port 306 along the axial direction A while each of apertures 374 and 376 are circumferentially offset from each of outlet ports 304 and 306. In this manner, a flow of fluid from pump 210 is supplied to multiple spray assemblies (e.g., 144 and 148). When disk 356 is rotated another 120 degrees to a third angular position 424, aperture 374 may be in fluid communication with fluid outlet port 306, but apertures 372, 376, and 378 are blocked, as is fluid outlet port 304. In detail, in the third angular position, aperture 374 may be aligned with outlet port 306 along the axial direction A while each of apertures 372, 376, and 378 are circumferentially offset from each of outlet ports 304 and 306. In this manner, a flow of fluid from pump 210 is supplied only to one spray assembly (e.g., 144 or 148). Finally, when disk 356 is rotated another 120 degrees, disk 356 has returned to its first angular position 420, and the initial single-spray operation is resumed. As such, passive diverter 300 may be used to selectively provide fluid flow from pump 210 through outlet ports 304 and 306 in three operating modes.

Figure 8:
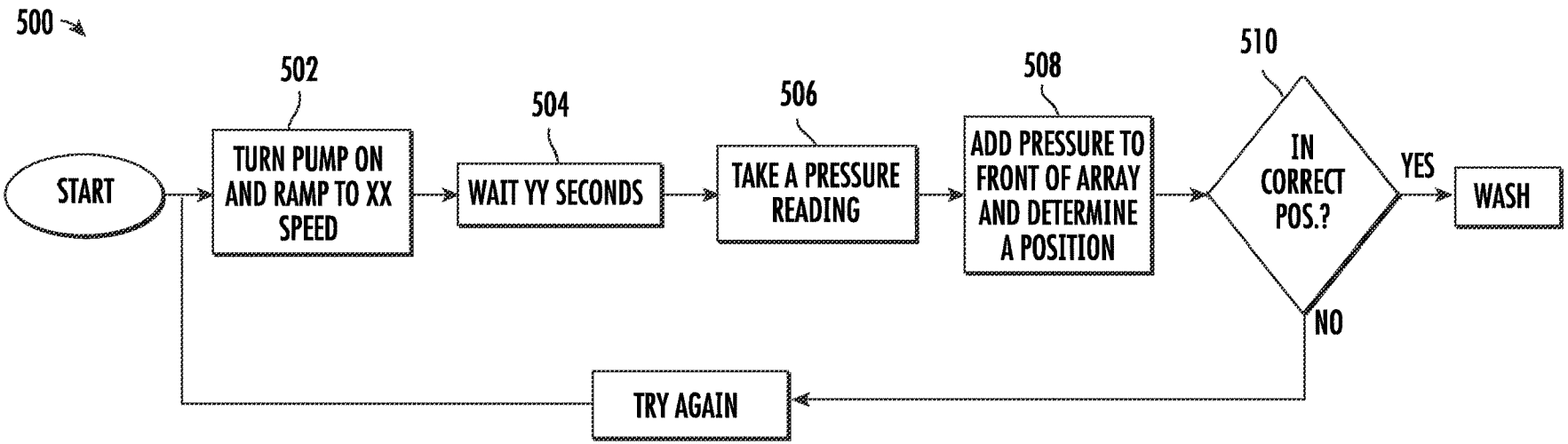
FIG. 8 is a flow chart illustrating a method of operating a dishwasher appliance according to exemplary embodiments.
Figure 9:
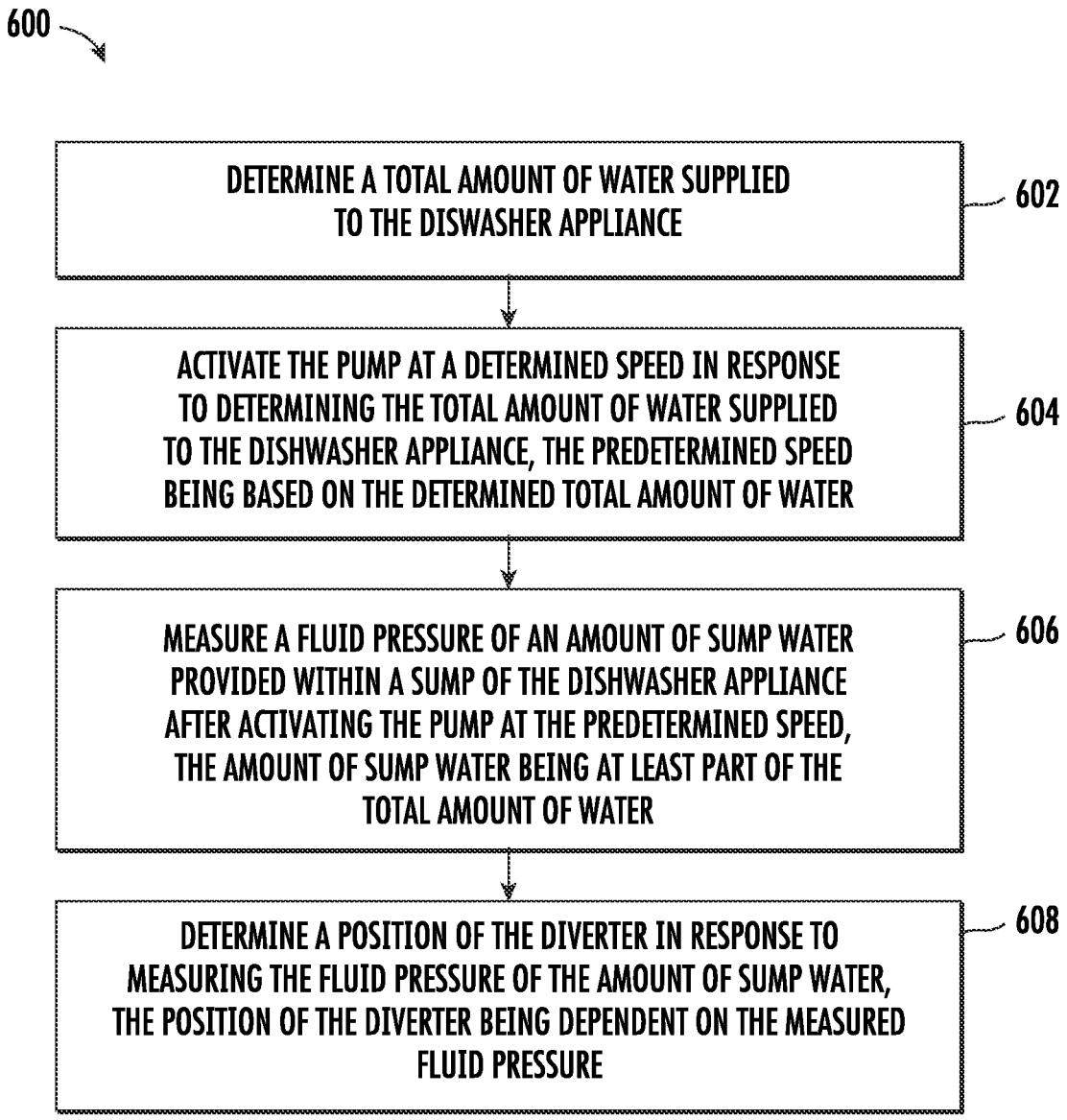
FIG. 9 is a flow chart illustrating a method of operating a dishwasher appliance according to exemplary embodiments.

Referring now to FIGS. 8 and 9, various methods of determining (e.g., setting, changing, or directing) a position of a diverter (e.g., diverter 300) will be explained. For instance, the methods described herein may be applied to dishwasher appliances including a passive diverter, such as diverter 300 described above. Moreover, the methods described herein may be performed by one or more controllers (e.g., controller 137) on board the dishwasher appliance, or a separate, dedicated controller.

FIG. 8 provides a flow chart indicating a method 500 for determining a position of a diverter within a dishwasher appliance. In detail, at 510, method 500 may include activating a pump (e.g., pump 210) at a predetermined speed. According to some embodiments, the pump is a variable pump. For instance, the pump may be operable at a variety of different speeds according to a percentage power input to a motor of the pump. The pump may be operated for a predetermined amount of time (e.g., at 504). The pump may be operated for the predetermined amount of time to generate stable and useful pressure readings within the dishwasher appliance (e.g., within a sump). The predetermined amount of time may be between about 8 seconds and about 12 seconds.

At 506, method 500 may include taking a pressure reading. For instance, the pressure reading may be taken after the predetermined amount of time has elapsed. In detail, a pressure sensor (e.g., pressure sensor 260) may be provided to measure a pressure (e.g., in mmH2O) within a sump (e.g., sump 200). The measured pressure may be noted or stored within a memory of the dishwasher appliance. For instance, the measured pressure may be stored in an array format (e.g., at 508).

At step 508, for instance, the measured pressure may be stored within the memory as a variable within an array (e.g., as 'x' in an array of [x, y, z]). Each pressure taken may be added to the front of the array. For example, the first measured pressure as x is moved to the middle position within the array when a second measured pressure is provided. In detail, if the second measured pressure is y, the array may be shifted to [y, x, z]. Subsequently, if a third measured pressure is z, the array may be shifted to [z, y, x]. Accordingly, each measured pressure associated with a rotational position of the diverter may be ascertained according to its position within the array, and a required number of pump activations may be determined to reach a desired position.

According to some embodiments, the measured pressure may be compared against a database or table of stored pressure levels. The stored pressure levels may correspond to the rotational position of the diverter. In detail, the measured pressure may be compared against a table to infer whether the diverter is in a first position, a second position, or a third position. As described above, the first, second, and third positions may correspond to a single-spray or a dual spray configuration.

According to some embodiments, steps 502 through 508 may be repeated. For instance, after storing the first measured pressure (e.g., in the array format), the pump may be deactivated. When fluid is not flowing due to the pumping action, a disk (e.g., disk 356) of diverter may be returned to a first position. Upon being returned to the first position, the disk may be rotated 120 degrees from the previous position. The pump may be reactivated and after the predetermined amount of time has elapsed, the pressure sensor may determine the pressure within the sump. The measured pressure may thus be added to the previously stored array. At this point, the array may include the second measured pressure followed by the first measured pressure. The method 500 may be repeated a third time to determine a third measured pressure, which may then be added to the array (e.g., in front of the second measured pressure).

At step 510, the method may include determining (e.g., ascertaining or estimating) that the diverter is in the correct position for a desired washing operation. In detail, a selected washing operation may require a dual-spray action (e.g., requiring each of a bottom spray arm assembly and a middle spray arm assembly). Thus, the method may determine whether the diverter (e.g., the disk) is in the proper position to perform the dual-spray action (e.g., the second position, or home position). Using the stored array of measured pressures, the controller may determine a position of the diverter disk according to the measured pressure. Once the diverter is determined to be in the correct position, the washing operation may commence.

Referring now to FIG. 9, a method 600 of operating a dishwasher appliance will be described. At step 602, method 600 may include determining a total amount of water supplied to the dishwasher appliance. In detail, the dishwasher appliance may include a water inlet, fluidly connected with a water supply such as a municipal water supply. A flow meter may be provided at the water inlet to measure a fluid amount of water supplied to the dishwasher appliance. Additional or alternative methods or instruments may be used to determine the amount of water supplied to the appliance, such as a weight sensor, a camera, an infrared sensor, or the like. Moreover, the amount of water supplied to the dishwasher appliance may be determined by detecting an amount of time for which a supply valve is open (e.g., with a constant known flow rate of water through the supply valve). The total amount of water supplied to the appliance may then be stored (e.g., within a memory of the appliance).

At step 604, method 600 may include activating the pump at a predetermined speed in response to determining the total amount of water supplied to the appliance. The predetermined speed may be based on the determined total amount of water. In detail, the total amount of water supplied to the appliance may be stored according to an amount (e.g., 0.80 gallons, 0.90 gallons, 1.00 gallons, etc.), or a percentage of maximum (e.g., 80% full, 90% full, 100% full, etc.). A corresponding operational speed of the pump may thus be correlated with the total amount of water supplied to the appliance. According to at least some embodiments, the operational speed of the pump is directly proportional to the total amount of water supplied to the appliance.

The predetermined speed of the pump may include a plurality of speeds. For instance, the plurality of speeds may include a first speed corresponding to a first amount of water, a second speed corresponding to a second amount of water, and a third speed corresponding to a third amount of water. The second speed may be greater than the first speed (e.g., when the second amount of water is greater than the first amount of water), while the third speed may be greater than the second speed (e.g., when the third amount of water is greater than the second amount of water). It should be understood that more or fewer speeds may be provided, stored, or incorporated according to embodiments. Additionally or alternatively, a corresponding pump speed may be determined or calculated according to the determined total amount of water (e.g., via one or more formulas, calculations, or algorithms).

The appropriate motor speed correlating to the total amount of water may be stored on board the appliance (e.g., within a look-up table). Thus, an appropriate pump speed may be selected and implemented upon determining the total amount of water. For instance, when less water is supplied to the appliance (e.g., 80% of a maximum), a slower pump speed should be used. Because of the presence of less water within the sump (e.g., as a function of less total water supplied to the appliance), a lower pump speed is required to generate accurate and discernible readings of water pressure through a diverter. In detail, when a maximum pump speed is used on, for instance, an 80% water capacity, pressure readings of water (e.g., within the sump) may be undetectable at each diverter position due to data noise generated by the high speed of water. Accordingly, the appliance may not accurately know at which position the diverter is before initiating the washing operation.

Similarly, when a total amount of water supplied to the appliance is at or near a maximum (e.g., 100% full), a relatively slow pump speed fails to generate enough volume of water moved for a pressure sensor to reliably notice a difference at each position. As would be expected, a dual-spray (or all-arm) action should reliably generate a lower pressure reading than a single-spray (only lower arm, only middle arm) action. Thus, when the pump speed is properly selected according to the total amount of water supplied to the appliance, a reliable position determination can be made (e.g., as described above with reference to method 500, specifically step 508).

At step 606, method 600 may include measuring the fluid pressure of an amount of sump water provided within the sump of the dishwasher appliance after activating the pump at the predetermined speed. The amount of sump water may be at least part of the total amount of water supplied to the appliance. In detail, after running the pump at the predetermined speed for a predetermined amount of time, the method may include instructing a pressure sensor (e.g., pressure sensor 260) to measure a pressure of the sump water. As mentioned above, the predetermined amount of time may be between about 8 second and about 12 seconds. Allowing the pump to operate for the predetermined amount of time may ensure that the pressure of water within the sump reaches an equilibrium, thus eliminating potential false readings.

At step 608, method 600 may include determining (e.g., ascertaining or estimating) a position of the diverter in response to measuring the fluid pressure of the amount of sump water. The position of the diverter may be dependent on the measured fluid pressure. As mentioned above, when the diverter is in the second position (e.g., a dual-spray action), a higher volume of water is pumped through diverter, as each water outlet (e.g., 204, 206) is accepting water therethrough. Accordingly, the second position may be referred to as a "home" position. By utilizing the array storing technique described above, a position of the diverter may be accurately determined according to a number of times the pump is activated (e.g., a number of times the diverter disk is rotated by 120 degrees and reseated. Moreover, the first position may correspond to a first measured fluid pressure, the second position may correspond to a second measured fluid pressure, and the third position may correspond to a third measured fluid pressure. The first fluid pressure and the third fluid pressure may each be greater than the second fluid pressure. Thus, the method may include determining that the lowest fluid pressure corresponds to the second position, which in turn corresponds to the dual-spray action.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance comprising:

a wash chamber selectively receiving articles for washing;

a sump provided in fluid communication with the wash chamber via a fluid circulation system;

a pump fluidly connected with the sump;

a diverter provided in the fluid circulation system; and a controller operably connected with the pump, the controller configured to perform a locating operation, the locating operation comprising:

determining a total amount of water supplied to the dishwasher appliance;

activating the pump at a predetermined speed in response to determining the total amount of water supplied to the dishwasher appliance, the predetermined speed being based on the determined total amount of water;

measuring a fluid pressure of an amount of sump water provided within the sump of the dishwasher appliance after activating the pump at the predetermined speed, the amount of sump water being at least part of the total amount of water; and determining a position of the diverter in response to measuring the fluid pressure of the amount of sump water, the position of the diverter being dependent on the measured fluid pressure.

2. The dishwasher appliance of claim 1, wherein the predetermined speed of the pump is proportionate to the amount of sump water within the sump.

3. The dishwasher appliance of claim 1, wherein the predetermined speed is one speed of a plurality of speeds, the plurality of speeds comprising:

a first speed corresponding to a first amount of water;

a second speed corresponding to a second amount of water, the second speed being greater than the first speed and the second amount of water being greater than the first amount of water; and a third speed corresponding to a third amount of water, the third speed being greater than the second speed and the third amount of water being greater than the second amount of water.

4. The dishwasher appliance of claim 1, wherein the measuring of the fluid pressure of the amount of sump water is performed a predetermined amount of time after the pump is activated, the predetermined amount of time being between 8 seconds and 12 seconds.

5. The dishwasher appliance of claim 1, wherein the diverter is movable between a first position, a second position, and a third position, the second position being associated with a dual arm operation mode of the dishwasher appliance.

6. The dishwasher appliance of claim 5, wherein the first position corresponds to a first measured fluid pressure, the second position corresponds to a second measured fluid pressure, and the third position corresponds to a third measured fluid pressure, the second measured fluid pressure being less than the first and second measured fluid pressures by a predetermined amount.

7. The dishwasher appliance of claim 6, wherein the locating operation further comprises:

establishing the second position as a home position of the diverter; and determining a position of the diverter according to a rotation of the diverter from the home position subsequent to establishing the second position as the home position.

8. The dishwasher appliance of claim 1, further comprising:

a pressure sensor in fluid communication with the sump, the pressure sensor selectively measuring the fluid pressure within the sump.

9. The dishwasher appliance of claim 1, wherein the dishwasher appliance comprises:

a water inlet in fluid communication with the sump through which municipal water is supplied to the dishwasher appliance; and a flow meter fluidly coupled at the water inlet, the flow meter configured to measure the total amount of water supplied to the dishwasher appliance.

* * * * *